United States Patent [19]

Karol et al.

[11] 4,420,210

[45] Dec. 13, 1983

[54] HERMETIC THROUGH BULKHEAD ELECTRICAL CONNECTOR

[75] Inventors: James J. Karol, Unadilla; Thornton J. Young, Bainbridge, both of N.Y.

[73] Assignee: The Bendix Corporation, Southfield, Mich.

[21] Appl. No.: 303,294

[22] Filed: Sep. 17, 1981

[51] Int. Cl.[3] ..... H01R 13/52

[52] U.S. Cl. ..... 339/94 M; 174/152 GM; 29/878

[58] Field of Search ..... 339/218 R, 147 R, 147 P, 339/94; 29/878, 469.5; 264/255, 272.11, 272.13; 156/294, 283; 174/152 SM, 50.61

[56] References Cited

U.S. PATENT DOCUMENTS

| | | | |
|---|---|---|---|
| 3,613,050 | 10/1971 | Andrews | 339/177 R |
| 3,721,948 | 3/1973 | Brandt et al. | 174/152 SM |
| 3,840,841 | 10/1974 | Clark | 339/147 P |
| 3,998,515 | 12/1976 | Panek | 339/117 P |
| 4,088,381 | 5/1978 | Harnett | 339/94 A |
| 4,140,613 | 2/1979 | Inoue et al. | 204/196 |
| 4,174,145 | 11/1979 | Oeschger | 339/94 A |

*Primary Examiner*—Eugene F. Desmond
*Assistant Examiner*—David Pirlot
*Attorney, Agent, or Firm*—John R. Benefiel; Raymond J. Eifler

[57] ABSTRACT

A through bulkhead electrical connector (10) is disclosed of the type having interfacial seals (30, 32) on either side of the connector precisely located axially for obtaining an effective interfacial seal. A standard glass bead (20) is fused to the connector shell (12) at one end thereof with carbon fixturing (44) enabling precise location after fusing. The opposite face is defined by a standard resinous insert (38) axially located by engagement with a shoulder (40) machined into the connector shell (12) with the intervening space (52) being filled with a cured mass of epoxy (42) to secure the resinous insert (38) in position.

3 Claims, 4 Drawing Figures

HERMETIC THROUGH BULKHEAD ELECTRICAL CONNECTOR

This invention concerns electrical connectors, and more particularly electrical connectors of the type mounted in a bulkhead or wall, with mating components mounted on either side of the connector sealed by means of an interfacial seal on each of the opposite faces of the connector.

In hermetically sealed connectors, a common design approach and one that works very effectively, is the provision of a glass bead insert which is disposed within the connector shell and surrounding each of the contacts. The glass insert is fused to the shell and contacts by heating to a relatively high temperature, i.e. 1800° F., to provide a reliable hermetic seal to the connector shell wall and also about each of the connector contacts.

Interfacial seals are typically employed to prevent the entry of moisture or condensing of moisture on the mating face of the connector, which could cause electrical failure between the contacts.

For these applications requiring such an interfacial seal installed over the end face of the component, an accurate axial positioning of the outer face of the glass insert is required. Commonly, tolerances within 0.010" are required for proper sealing engagement.

Such precise location is achieved by fixturing including a carbon mandrel having an upper face which locates the downwardly positioned face of the glass insert relatively precisely during the fusing step, due to the effects of gravity. For through bulkhead type connectors, a problem has been encountered in establishing a precise location of a double seal facing of the connector. Such double face seal is sometimes required for this type of connector since there are mating connector components in engagement on each of the opposite faces of the connector. This problem is created since the glass, when undergoing fusing, cannot be located against a shoulder or any other such feature of the connector shell within the relatively close tolerancing required.

In addition, for such applications the insert is often of an extra thick, nonstandard design, increasing the cost of manufacture of such connectors.

In other instances pairs of glass inserts are provided at either face abutting a solid member in the space intermediate the glass inserts. In one prior art arrangement, a flowable material is placed into the space, which is removed after these inserts are fused.

In another prior art arrangement a ceramic spacer is located intermediate to glass bead inserts at opposite faces of the connector.

In both of these arrangements, relatively elaborate connector structure is required including an intermediate chamber defined between the glass inserts. In addition, relatively complex procedures are employed during the fusing of the respective glass inserts to the contacts and the connector shell.

It should be noted that it is difficult to control the location of a fused glass surface except by fixturing having an upper face against which the glass is gravity biased into engagement. In other orientations of location surfaces the final location of a glass bead surface cannot be determined with precision. That is, if the carbon fixture is applied above the surface, the final fused surface is not necessarily defined at that point since the glass in melting may recede from the fixture surface.

DISCLOSURE OF THE INVENTION

The present invention provides a hermetic through bulkhead connector of the type requiring a double interfacial seal, in which each surface against which the interfacial seal is located is precisely located in order to ensure a proper sealing function.

The present invention also provides such a hermetic through bulkhead double seal electrical connector in which standard components may be employed in the manufacture of the connector. The present invention further provides a method of manufacturing such hermetic through bulkhead electrical connector which does not involve elaborate manufacturing steps and which does not require a complex configuration of the connector shell body or the use of extra components for the purpose of attempting to locate the opposing connector faces with adequate precision.

These advantages are achieved by a connector shell formed with an internal, precisely located shoulder, which serves to accurately locate a resinous insert, defining one sealing face; and the opposite sealing face defined by a standard glass bead insert which is fused in place initially by a conventional carbon fixturing set up.

The intervening space is filled with a mass of powdered epoxy resin, the resinous insert and powdered epoxy being heat cured at the same time elastomer interfacial seals are being bonded to the fused glass bead insert and the resinous insert.

The hermetic seal is thus defined by a single glass bead insert of standard thickness while good interfacial sealing is provided at both faces of the connector due to the accurate position at which each surface may be located.

DETAILED DESCRIPTION OF THE INVENTION

Figure 1:
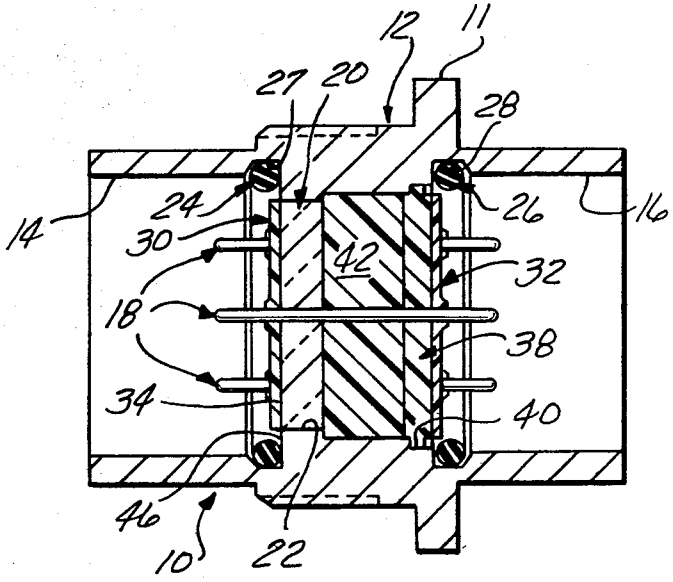
FIG. 1 is a view in longitudinal section of the connector according to the present invention.

Referring to FIG. 1, the electrical connector 10 according to the concept of the present invention is adapted to be mounted in a through bulkhead installation, mounted thereto by a flange 11 with mating components adapted to be received within bores 14 and 16 on either end thereof such as to mate with the contacts 18 on either side. The connector 10 is designed to be hermetically sealed, which is achieved by a fusing of a glass insert or bead 20 against the bore 22 of the connector shell 12. The connector 10 is also adapted to be sealed by means of packing seals 24 and 26 received in seal recesses 27 and 28, respectively, to engage the outer periphery of the mating receptacle components (not shown).

In addition each of the mating faces are adapted to be sealed by elastomer interfacial seals 30 and 32 mounted on the opposite end faces of the connector 10. Interfacial seal 30 is bonded to the end surface 34 of the glass bead insert 20, while interfacial seal 32 is bonded to an end surface 36 of a resinous insert 38.

Resinous insert 38 is precisely located by means of a shoulder 40 machined into the interior bore of the connector shell 12, bonded by a cured interposed mass of epoxy indicated at 42.

The glass bead 20 and resinous mass 42 are also fused to the perimeter of each of the contacts 18.

Figure 2:
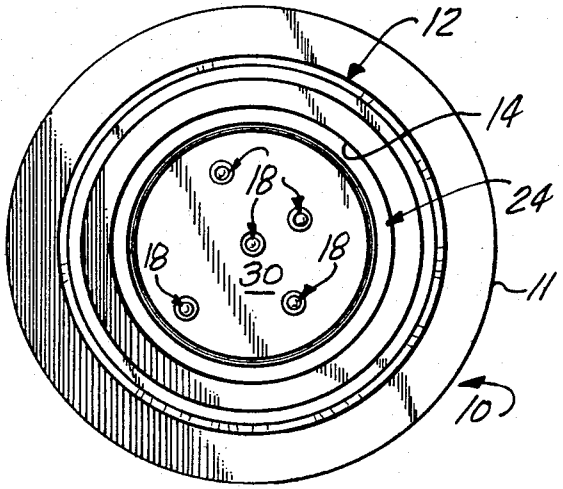
FIG. 2 is an end-wise view of the connector shown in FIG. 1.

Referring to FIG. 2, an array of contacts 18 are distributed across the outer face of the seal 30 for mating with another connector (not shown), the number and location varying with each particular design.

According to the present invention, each of the surfaces 34, 36 to which are mounted the interfacial seals 30 and 32, are relatively precisely located axially with respect to the connector shell 12 such that sealing at the interfaces can be achieved reliably. This precision location is achieved by the design of the connector as well as the manufacturing steps employed.

Figure 3:
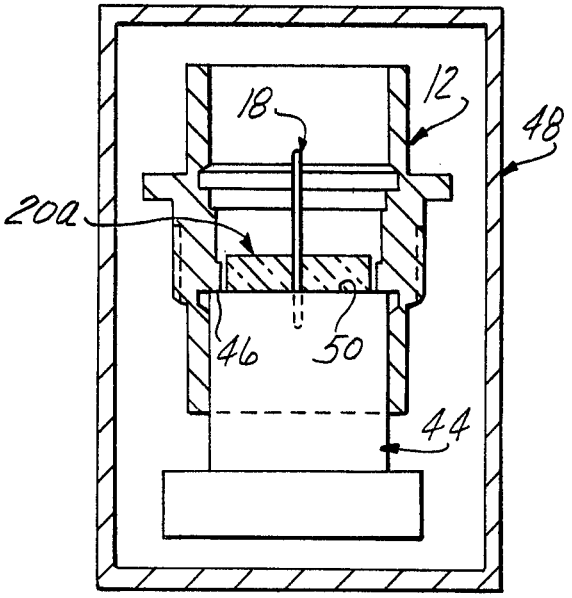
FIG. 3 is a sectional view of certain of the electrical connector components assembled together and disposed in a fusing chamber during the fusing of the glass bead insert.

The initial step is shown in FIG. 3 in which the machined connector shell 12 is assembled onto a carbon fixture 44 in abutment against the shoulder 46 which is substantially flush with the axial position desired for the fused glass insert 20. A glass bead preform 20*a* corresponding to the glass insert 20 is placed in position over the contacts. The glass bead preform 20*a* is sized with a slightly lesser diameter than the bore 22 and with a slightly greater depth than the length of the bore 22.

The assembly is then placed in a fusing oven represented by the enclosure 48, then heated to a proper fusing temperature, on the order of 1800° F., which causes the preform 20*a* to melt and be fused to the bore 22 and the periphery of the contacts 18 at the same time filling completely the bore 22. The upper surface 50 of the carbon fixture 44 is precisely located with respect to the shoulder 46 and thus provides a relatively precise location of the final fused surface 34 of the glass bead insert 20.

In the next phase the necessary conductive plating of the contacts 18 and connector shell 12 is carried out.

Since this and other intermediate steps do not form a part of the present invention, a detailed description is not here included.

Figure 4:
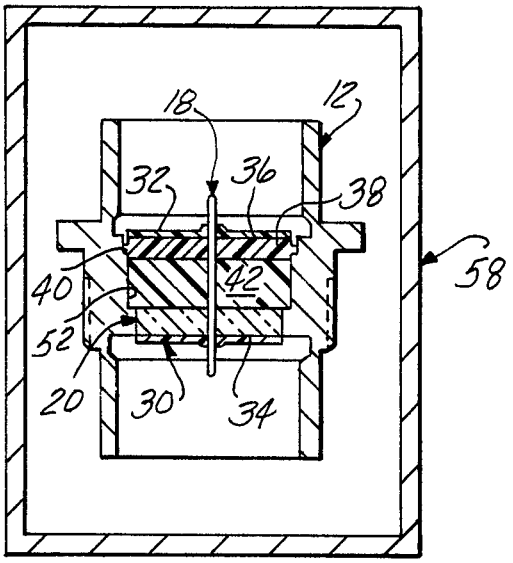
FIG. 4 is a partial sectional view of the connector components assembled together and placed in a heat curing oven.

The other components to be sealed with respect to each other, the shell 12, and the contacts 18 are then assembled, as shown in FIG. 4, with a quantity of powdered epoxy deposited above the glass bead insert 20, into the space 52. The resinous insert 38 is then assembled into the connector cavity against the precision shoulder 40 machined into the connector shell 12 to provide a precision location of the outside face 36 thereof. The interfacial seals 30 and 32 are then assembled over the contacts 18 and into abutment with the respective faces 34 and 36.

The entire assembly is then placed into a heat curing oven 58 to provide curing of the epoxy powder mass 42 and bonding of the interfacial seals 30 and 32 thereto. This produces a bonding to the contacts 18 and to the interior bore 52 of the connector shell 12.

Accordingly it can be appreciated that the above advantages of the present invention have been achieved by the hermetic connector described and the method of manufacture thereof inasmuch as close tolerance location of the double interfacial seals are each achieved with a high degree of reliability while maintaining the hermetically sealed construction thereof. At the same time elaborate and complex connector structures are avoided as well as complicated manufacturing procedures. Furthermore this construction does not require the use of special thickness glass beads or nonstandard inserts but employs only standard thickness inserts of the type which have been previously used heretofore in other connector designs.

Having described the invention, what is claimed is:

1. In combination with a hermetic through-bulkhead electrical connector comprising a generally cylindrical connector shell, at least one contact mounted within said shell, the improvement comprising a glass bead insert fused to said shell and said contact, and having an end face at a precisely predetermined axial location; a first interfacial seal bonded to said end face; a non-conductive, non-glass insert bonded to the interior of said connector shell and to said at least one contact at an axially spaced location from the opposite side of said glass bead insert, said connector shell being formed with an internal shoulder and said non-glass insert located against said shoulder, thereby defining a second precisely located end face remote from said fused glass bead insert; and a second interfacial seal bonded to said second end face, whereby two precisely located interfacial seals may provide effective interfacial sealing on either side of said connector.

2. The electrical connector according to claim 1 further including a mass of resin bonded to said connector shell and interposed between said glass bead insert and said non-conductive insert.

3. The electrical connector according to claim 2 wherein said second insert is composed of a resinous material.

* * * * *